US012435950B2

(12) United States Patent
Nguyen

(10) Patent No.: US 12,435,950 B2
(45) Date of Patent: Oct. 7, 2025

(54) HANDGUN OPTIC MOUNTING SYSTEM

(71) Applicant: Tu Nguyen, Escondido, CA (US)

(72) Inventor: Tu Nguyen, Escondido, CA (US)

( * ) Notice: Subject to any disclaimer, the term of this patent is extended or adjusted under 35 U.S.C. 154(b) by 60 days.

(21) Appl. No.: 18/634,966

(22) Filed: Apr. 14, 2024

(65) Prior Publication Data

US 2024/0344807 A1 Oct. 17, 2024

Related U.S. Application Data

(60) Provisional application No. 63/459,595, filed on Apr. 14, 2023.

(51) Int. Cl.
*F41G 1/26* (2006.01)

(52) U.S. Cl.
CPC ..... *F41G 1/26* (2013.01)

(58) Field of Classification Search
CPC . F41G 1/26; F41G 11/003; F41G 1/06; F41G 1/16
USPC ..... 42/124–127
See application file for complete search history.

(56) References Cited

U.S. PATENT DOCUMENTS 10,352,654 B2 * 7/2019 Costet ..... F41G 11/001
11,131,526 B2 * 9/2021 Shawley ..... F41G 1/06
11,543,213 B2 * 1/2023 Niswander ..... F41G 11/003
11,815,332 B2 * 11/2023 Eaton ..... F41G 1/28
2014/0230305 A1 * 8/2014 Zimmer ..... F41C 3/00 42/111
2015/0241175 A1 * 8/2015 Wolf ..... F41G 11/005 42/124
2017/0184375 A1 * 6/2017 Huff ..... F41G 11/003
2020/0232601 A1 * 7/2020 Chavez ..... F16M 11/041
2022/0307800 A1 * 9/2022 Niswander ..... F41G 11/00

* cited by examiner

*Primary Examiner* — John Cooper
(74) *Attorney, Agent, or Firm* — CP LAW GROUP PC; Cy Bates

(57) ABSTRACT

A handgun optic mounting system is disclosed for improving accuracy and durability with use of an optic mount to a handgun. The handgun optic mounting system includes an optic recess disposed on a handgun slide of the handgun, the optic recess having a recessed surface angled relative to an upper surface of the handgun slide, a barrel central axis, or both. Angle of the recessed surface provides compensation to bullet drop at longer ranges. The handgun optic mounting system further includes a plurality of threaded apertures extending into the recessed surface including a first aperture and a second aperture. The first aperture has a single mounting protrusion extending above the recessed surface, and the second aperture terminates flush with the recessed surface, allow a larger fastener to engage with the second aperture to create a greater clamping force with an associated optic mount.

19 Claims, 3 Drawing Sheets

HANDGUN OPTIC MOUNTING SYSTEM

CROSS-REFERENCE TO RELATED APPLICATIONS

This application claims benefit of priority with U.S. Provisional Application Ser. No. 63/459,595, filed Apr. 14, 2023; the entire contents of which are hereby incorporated by reference.

BACKGROUND

Field of the Invention

This disclosure relates to a handgun optic mounting system, and more particularly to mounting systems that improve durability and accuracy of an associated optic mount.

Description of the Related Art

Conventional handguns were used for short-range shooting, between 0-25 yards. Recently, more handguns are equipped with optic mounts for improved accuracy. However, at mid-range to long-range distances, which can range from 25-100 yards or more, accuracy with a handgun decreases due to handguns generally having a lower muzzle velocity than rifles which allows a bullet's trajectory to be more greatly influenced by gravity. Some conventional techniques include angling the handgun to compensate for the bullet drop however it requires significant skill and can be challenging during stressful and urgent times.

In conventional optic mounting systems for guns, and more specifically handguns, there are two hardware mounting apertures on the recessed surface. In some conventional handgun optic mounting systems, the threaded mounting apertures can include mounting protrusions which elevate the threaded apertures above the recessed surface to provide an optic mount with additional threaded engagement. For example, a gun optic system involving two mounting protrusions is disclosed by Alec Daniel Wolf. in patent USRE47335E1, reissued Apr. 2, 2019. However, when threaded mount protrusions are used, a thinner and weaker fastener must be used due to the threaded mounting apertures having a decreased diameter.

SUMMARY

A handgun optic mounting system is disclosed for improving accuracy and durability with use of an optic mount to a handgun. The handgun optic mounting system comprises an optic recess disposed on a handgun slide of the handgun, the optic recess having a recessed surface angled relative to an upper surface of the handgun slide, a barrel central axis, or both. Angle of the recessed surface improves accuracy at longer ranges. The handgun optic mounting system further comprises a plurality of threaded apertures extending into the recessed surface including a first aperture and a second aperture. The first aperture has a single mounting protrusion extending above the recessed surface, and the second aperture terminates flush with the recessed surface, allow a larger fastener to engage with the second aperture to create a greater clamping force with an associated optic mount.

Accuracy is improved by the handgun mounting system due to the angle, or tilt, of the recessed surface relative to the upper surface or barrel central axis of the handgun slide. A shooter will use an attached optic mount for aiming, which comprises the corresponding tilt of the recessed surface. Targeting with the tilted optic mount will naturally cause the handgun slide, including the barrel central axis, to tilt upwards which will reduce effects of bullet drop at long ranges. Any negative impact to short range accuracy due to the tilted recessed angle is minimal due to shorter ranges requiring less accuracy.

Durability is improved by the second aperture having a flush termination with the recessed surface compared to the first aperture comprising the single mounting protrusion. The single mounting protrusion maybe required when an obstruction within the handgun slide prevents the first aperture from fully extending into the handgun slide, thereby preventing sufficient thread engagement. The single mounting protrusion compensates for this limitation. However, to properly fit within mounting holes of the associated optic mount, a smaller diameter of the first aperture is required due to the single mounting protrusion occupying space within one of the mounting holes. The second aperture, which has no associated obstruction and can fully extend into the handgun slide, does not comprise a protrusion and so the second aperture comprises a greater diameter to receive a larger fastener. A larger fastener allows for a greater clamping force which will increase durability of the optic mount and engagement with the handgun slide.

BRIEF DESCRIPTION OF THE DRAWINGS

Other features, combinations, and embodiments will be appreciated by one having the ordinary level of skill in the art of firearms and accessories upon a thorough review of the following details and descriptions, particularly when reviewed in conjunction with the drawings, wherein.

DETAILED DESCRIPTION

Figure 1:
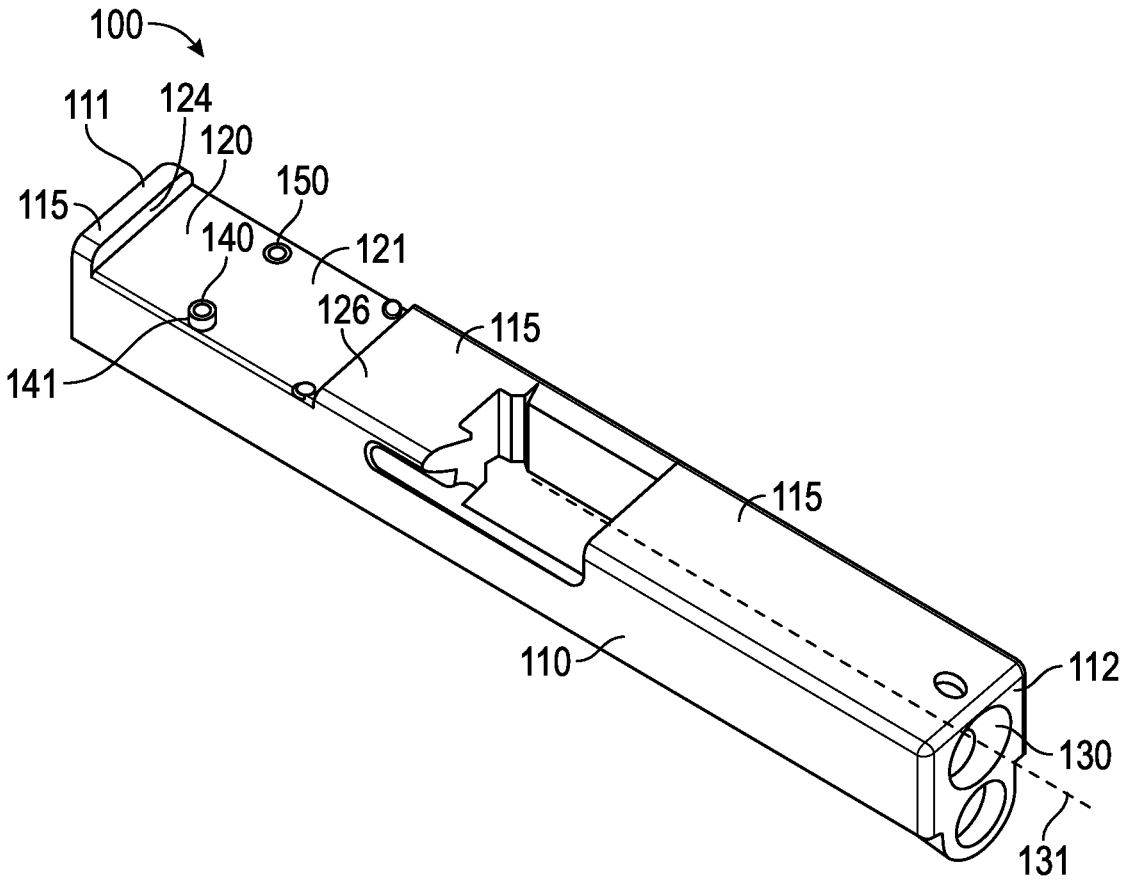
FIG. 1 shows a perspective view of a handgun optic mounting system in accordance with a first illustrated embodiment.
Figure 2:
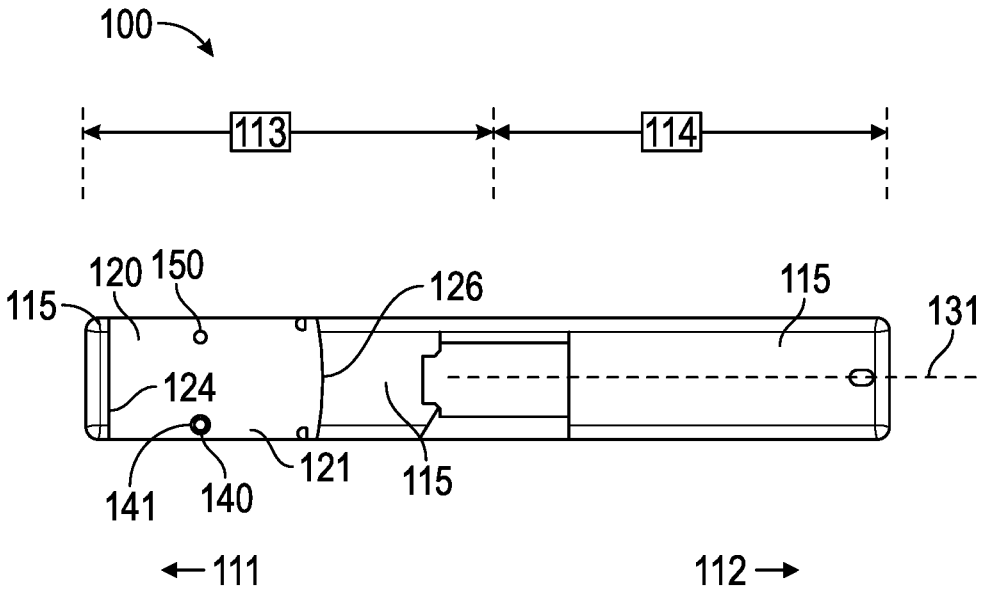
FIG. 2 shows a top view of the handgun optic mounting system according to the first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "proximal end" means an end of a handgun slide nearest a shooter.

The term "optic recess" means a recess on a handgun slide configured to receive an optic mount such that the optic device is configured to mount on a recessed surface of the optic recess.

The term "optic mount" means an optical sighting device configured to engage with a firearm.

The term "mounting hole" means holes of the optic mount used to engage with the firearm.

The term "extractor chamber" means a chamber associated with an extractor for hooking onto the rim of a cartridge case.

The term "angled" means not parallel.

The term "anteriorly tilted" means a forward tilt of a recessed surface relative to a shooter such that a portion of an optic mount disposed closer to the distal end is lower than a portion of the optic mount disposed closer to the proximal end.

The term "threaded engagement" means an area of contact between threads of a fastener and threads of a receiving first and second threaded apertures.

The term "bullet drop" means an effect on a bullet at mid to long ranges which causes a downwards curve due to gravity.

The term "handgun" means a type of firearm design to be handheld. Handguns are distinguished from rifles and shotguns that are larger and generally require both hands for stable operation.

Unless explicitly defined herein, terms are to be construed in accordance with the plain and ordinary meaning as would be appreciated by one having skill in the art.

General Description of Embodiments

In one general embodiment, a handgun optic mounting system is disclosed. The handgun optic mounting system comprises a handgun slide having a proximal end and a distal end opposite the proximal end. A first half is disposed at the proximal end and a second half is disposed on the distal end. The handgun slide further comprises an upper surface and a barrel aperture having a barrel central axis. An optic recess is disposed on the handgun slide, the optic recess having a recessed surface disposed lower than the upper surface. The recessed surface forms a recess plane anteriorly tilted wherein the recess plane comprises a recessed angle with at least one of the upper surface or the barrel central axis. The recessed angle comprises a value between and inclusive of 5 to 25 minutes of angle. A plurality of threaded apertures extends into the recessed surface, the plurality of threaded apertures comprising a first aperture and a second aperture. The first aperture comprises a single mounting protrusion extending above the recessed surface and the second aperture terminates flush with the recessed surface. The first aperture further comprises a first diameter and the second aperture comprises a second diameter wherein the second diameter is greater than the first diameter.

In some embodiments, wherein the optic recess may be disposed on the upper surface of the handgun slide.

In some embodiments, the optic recess may further comprise a proximal boundary extending from the upper surface to the recessed surface to form a first height, the optic recess further comprising a distal boundary extending the from the upper surface to the recessed surface to form a second height, wherein the second height is greater than the first height.

In some embodiments, the recessed surface may further comprise a plurality of alignment elements.

In some embodiments, the optic recess may be disposed at the first half.

In some embodiments, the single mounting protrusion may comprise threads.

In some embodiments, the handgun slide may further comprise an extractor chamber, wherein the extractor chamber is disposed below the first aperture.

In some embodiments, the first aperture may extend from the recessed surface to a first terminal end to form a first aperture depth, and the second aperture extends from the recessed surface to a second terminal end to form a second aperture depth, wherein the second aperture depth is greater than the first aperture depth.

In another general embodiment, a handgun optic mounting system is disclosed. The handgun mounting system comprises a handgun slide having a proximal end and a distal end opposite the proximal end. A first half is disposed at the proximal end and a second half is disposed on the distal end. The handgun slide further comprises an upper surface and a barrel aperture having a barrel central axis. An optic recess is disposed on the handgun slide. The optic recess comprises a recessed surface disposed lower than the upper surface, the recessed surface forming a recess plane wherein the recess plane is angled with at least one of the upper surface or the barrel central axis.

In some embodiments, the optic recess may be disposed on the upper surface of the handgun slide.

In some embodiments, the recess plane is anteriorly tilted.

In some embodiments, the system may further comprise a recessed angle formed by the recess plane and at least one of the upper surface or the barrel central axis. The recessed angle may comprise a value between and inclusive of 5 to 25 minutes of angle.

In some embodiments, the optic recess may further comprise a proximal boundary extending from the upper surface to the recessed surface to form a first height, the optic recess further comprising a distal boundary extending the from the upper surface to the recessed surface to form a second height, wherein the second height is greater than the first height.

In some embodiments, the recessed surface may further comprise a plurality of alignment elements.

In some embodiments, the optic recess may be disposed at the first half.

In some embodiments, the optic recess may further comprise a plurality of threaded mounting apertures, the plurality of threaded mounting apertures comprising a first aperture and a second aperture each extending into the recessed surface, wherein the first aperture comprises a single mounting protrusion extending above the recessed surface, and further wherein the second aperture terminates flush with the recessed surface. The single mounting protrusion may comprise threads.

In some embodiments, the first aperture may further comprise a first diameter and the second aperture may further comprise a second diameter wherein the second diameter is greater than the first diameter.

In some embodiments, the handgun slide may further comprise an extractor chamber, wherein the extractor chamber is disposed below the first aperture.

In some embodiments, the first aperture may extend from the recessed surface to a first terminal end to form a first aperture depth, and the second aperture extends from the recessed surface to a second terminal end to form a second aperture depth, wherein the second aperture depth is greater than the first aperture depth.

In another general embodiment, A handgun optic mounting system is disclosed. The handgun optic mounting system comprises a handgun slide having a proximal end, a distal end, a first half disposed at the proximal end, a second half disposed on the distal end, and an upper surface. The handgun slide further comprises a barrel aperture having a barrel central axis. An optic recess is disposed on the handgun slide, the optic recess having a recessed surface disposed lower than the upper surface. A plurality of threaded apertures extends into the recessed surface, the plurality of threaded apertures comprising a first aperture and a second aperture. The first aperture comprises a single mounting protrusion extending above the recessed surface and the second aperture terminates flush with the recessed surface. The first aperture further comprises a first diameter and the second aperture further comprises a second diameter wherein the second diameter is greater than the first diameter.

In some embodiments, the optic recess may be disposed on the upper surface of the handgun slide.

In some embodiments, the recessed surface may further comprise a plurality of alignment elements.

In some embodiments, the optic recess may be disposed at the first half.

In some embodiments, the single mounting protrusion may comprise threads.

In some embodiments, the handgun slide may further comprise an extractor chamber, wherein the extractor chamber is disposed below the first aperture.

In some embodiments, the first aperture may extend from the recessed surface to a first terminal end to form a first aperture depth, and the second aperture may extend from the recessed surface to a second terminal end to form a second aperture depth, wherein the second aperture depth is greater than the first aperture depth.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims. One having skill in the art will appreciate the features disclosed herein can be used together or separately to achieve various utility.

Illustrated Embodiments

Now turning to the drawings, FIG. 1-6 show a handgun optic mounting system in accordance with a first illustrated embodiment. The system comprises a handgun slide (100) having a proximal end (111) nearest to a shooter and a distal end (112) furthest from the shooter. The handgun slide (100) further comprises a barrel aperture (130) through which the barrel is disposed when the handgun slide is assembled with a handgun. The barrel aperture shares a same central axis as a gun barrel defined as a barrel central axis (131). An optic recess (120) is disposed on the handgun slide such that an optic mount may be mounted therewith. The optic recess comprises a recessed surface (121) which is lower than an upper surface (115) formed by one or more co-planar top surfaces of the handgun slide.

A proximal extent of the recessed surface (121) may be defined by a proximal boundary (124). The distance between the recessed surface and the upper surface (115) at the location of the proximal boundary may be referred to as the first height (125). Additionally, a distal extent of the recessed surface (121) may be defined by a distal boundary (126). The distance between the recessed surface and the upper surface (115) at the location of the distal boundary may be referred to as the second height (127). An angular difference between the recessed surface and the upper surface may be evidenced by a difference between the first height and the second height such that the second height is greater than the first height. The angled orientation of the recessed surface and the upper surface allows a shooter to more accurately aim at mid-range and long-range distances. The shooter, whiling use the optic mount to aim, will naturally tilt the handgun upwards due to a forward tilt of the recessed surface. The tilt of the handgun will correct bullet drop from gravity. Additionally, short-range will be minimally affected by any tilt of the handgun because of the closer range.

The recessed surface (121) further comprises a plurality of alignment elements. Alignment elements may help the user align the optic within the optic recess during installation. Alignment elements may also help to keep the optic aligned within the optic recess during use of the gun.

The optic recess (120) may be disposed towards the anterior end of the slide which is referred to as a first half (113) of the handgun slide (100). A second half (114) of the handgun slide extends from a midpoint on the handgun slide towards the distal end (112) of the slide. In other embodiments, the optic recess may be disposed on the second half of the slide.

The optic recess (120) features a plurality of threaded mounting apertures. The plurality of threaded mounting apertures comprises a first aperture (140) having a single mounting protrusion (141) to raise threads of the first aperture above the recessed surface (121). The second aperture (150) lacks a mounting protrusion and terminates flush to the recessed surface.

Figure 3:
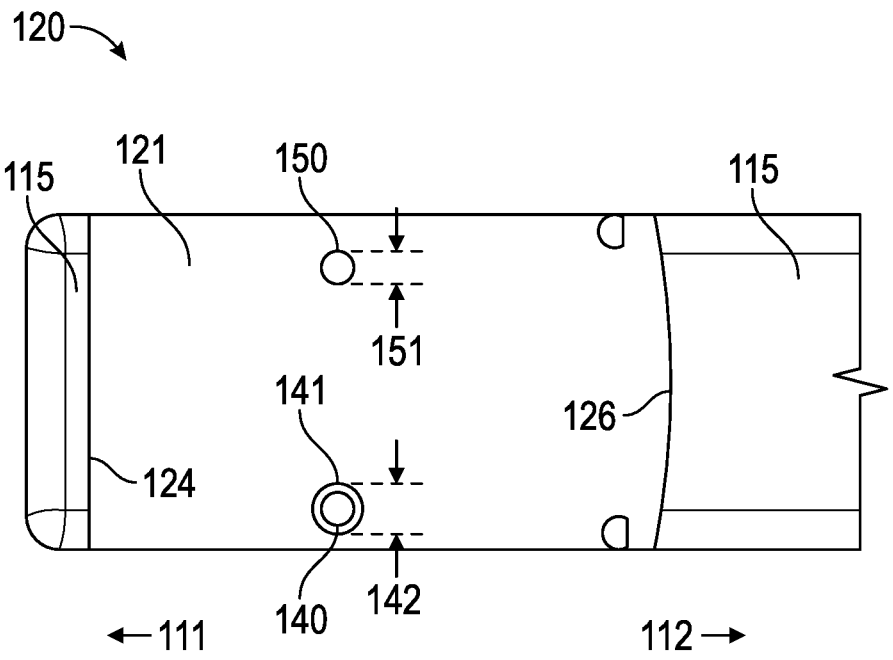
FIG. 3 shows a top view of a optic recess of the handgun optic mounting system according to the first illustrated embodiment.

As shown in FIG. 3 a threaded diameter of the first aperture (140), called a first diameter (142), may have a given size such that with the single mounting protrusion (141) of the first aperture is configured to accommodate a mounting hole of an optic mount. A threaded diameter of the second aperture (150), called a second diameter (151), is larger than the first diameter. The second diameter being larger than the first diameter is due to the second aperture not requiring a mounting protrusion to extend the aperture threads above the recessed surface. Because of the lacking of a mounting protrusion on the second aperture, the second diameter is capable of being larger so that the second aperture is configured to accommodate a same sized mounting hole of the optic mount as the first aperture. Use of a fastener that is larger and has more threaded engagement within the handgun slide as opposed to the mounting protrusion, will increase the clamping force of said fastener which will increase durability of an associated optic mount.

Figure 4:
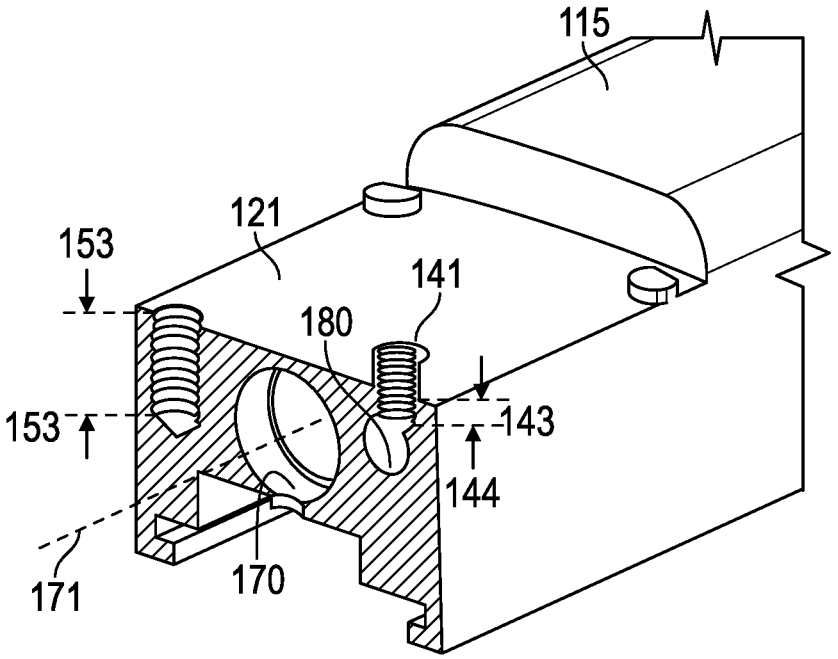
FIG. 4 shows a top rear cutaway view of the optic recess according to the first illustrated embodiment.

As shown in FIG. 4 the handgun slide (100) comprises an extractor chamber (180) configured to hold a pistol extractor component. In some embodiments, the extractor chamber may be located below the first aperture (140). When the extractor chamber is located below the first aperture it may obstruct the available threaded depth of the first aperture below the recessed surface (121). As further illustrated, there is no obstruction below the location of the second aperture (150).

A lowest extent of threads of the first aperture (140) is defined as a first terminal end (143). The distance between the recessed surface and the first terminal end is defined as a first aperture depth (144). A lowest extend of threads of the second aperture (150) is defined as a second terminal end (152). The distance between the recessed surface and the second terminal end is defined as a second aperture depth (153). The second aperture depth is greater than the first aperture depth due to an absence of obstruction below the second aperture that allows the second aperture to extend further into the handgun slide. Because the second aperture depth is longer than the first aperture depth, the second aperture does not require a mounting protrusion like the first aperture. In such embodiments, a top of the second aperture is flush with the recessed surface (121). Due to the second aperture being devoid of a mounting protrusion extending above the recessed surface, the second aperture may comprise a wider diameter than the first diameter of the first aperture.

The handgun slide (100) comprises a firing pin channel (170) configured to hold a firing pin. The firing pin channel may be disposed within the handgun slide having a firing pin axis (171) which passes longitudinally through the center of the firing pin channel. In some embodiments, the longitudinal axis of the firing pin channel and longitudinal axis of the barrel aperture (130) are presumed to be parallel with each other. In some embodiments, the firing pin axis, the barrel central axis (131), and the upper surface (115) are all parallel to each other.

Figure 5:
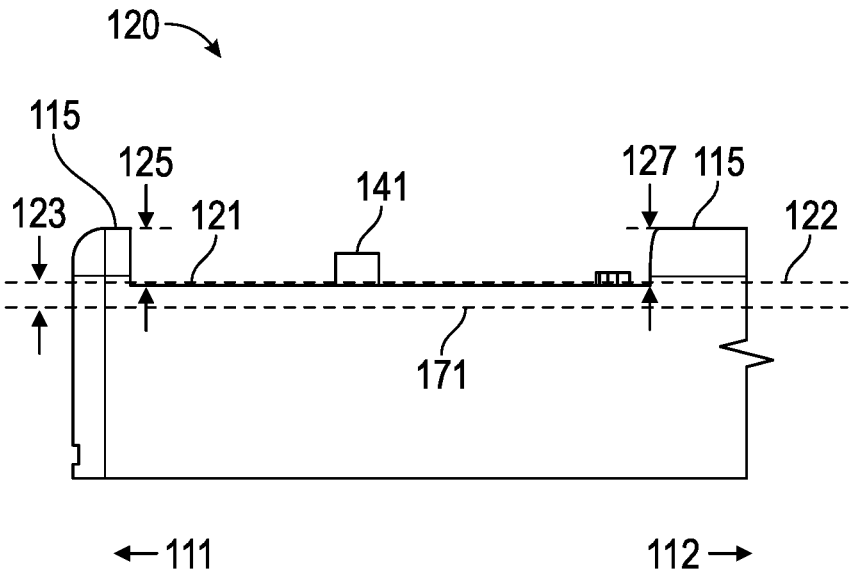
FIG. 5 shows a side profile view of the optic recess according to the first illustrated embodiment.
Figure 6:
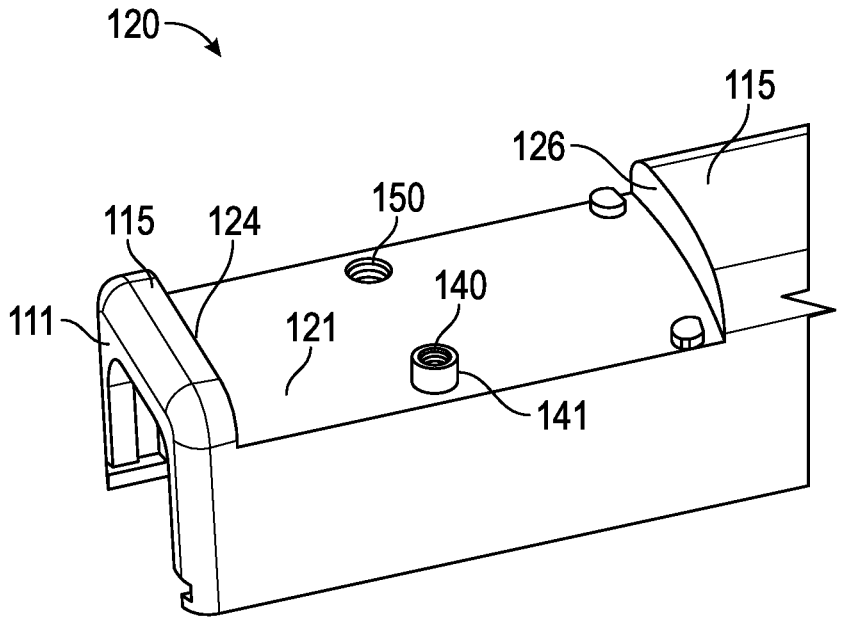
FIG. 6 shows a perspective view of the optic recess according to the first illustrated embodiment.

As shown in FIG. 5, the recessed surface (121) coincides with a recess plane (122). The recess plane is not parallel, to the central barrel axis (131), the firing pin axis (171), or both. The recess plane is anteriorly tilted with respect to the firing pin axis. The angle formed between the recess plane (122) and the firing pin axis (171), which is presumed to be parallel with the barrel central axis, is called a recessed angle (123). In some embodiments, the recessed angle comprises a value between and inclusive of 5-25 minutes of angle (MOA). An MOA lower of 5 does not provide an increased long-distance accuracy. An MOA greater than 25 will negatively effect short term accuracy.

Generally, the handgun slide is made of metal. Otherwise, the handgun slide can be fabricated in accordance with the level and knowledge of one having skill in the art.

While various details, features, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

FEATURE LIST handgun slide (100)
slide body (110)
proximal end (111)
distal end (112)
first half (113)
second half (114)
upper surface (115)
optic recess (120)
recessed surface (121)
recess plane (122)
recessed angle (123)
proximal boundary (124)
first height (125)
distal boundary (126)
second height (127)
barrel aperture (130)
barrel central axis (131)
first aperture (140)
single mounting protrusion (141)
first diameter (142)
first terminal end (143)
first aperture depth (144)
second aperture (150)
second diameter (151)
second terminal end (152)
second aperture depth (153)
firing pin channel (170)
firing pin axis (171)
extractor chamber (180)

What is claimed is:

1. A handgun optic mounting system, comprising:

a handgun slide having a proximal end, a distal end, a first half disposed at the proximal end, a second half disposed on the distal end, and an upper surface, the handgun slide comprising a barrel aperture having a barrel central axis;

an optic recess disposed on the handgun slide, the optic recess having a recessed surface disposed lower than the upper surface, the recessed surface forming a recess plane anteriorly tilted wherein the recess plane comprises a recessed angle with at least one of the upper surface or the barrel central axis, wherein the recessed angle comprises a value between and inclusive of 5 to 25 minutes of angle; and a plurality of threaded apertures extending into the recessed surface, the plurality of threaded apertures comprising a first aperture and a second aperture, wherein the first aperture comprises a single mounting protrusion extending above the recessed surface and the second aperture terminates flush with the recessed surface, wherein the first aperture further comprises a first diameter and the second aperture comprises a second diameter wherein the second diameter is greater than the first diameter.

2. The handgun optic mounting system of claim 1, the optic recess further comprising a proximal boundary extending from the upper surface to the recessed surface to form a first height, the optic recess further comprising a distal boundary extending the from the upper surface to the recessed surface to form a second height, wherein the second height is greater than the first height.

3. The handgun optic mounting system of claim 1, the recessed surface further comprising a plurality of alignment elements.

4. The handgun optic mounting system of claim 1, wherein the optic recess is disposed at the first half.

5. The handgun optic mounting system of claim 1, wherein the single mounting protrusion comprises threads.

6. The handgun optic mounting system of claim 1, the handgun slide further comprising an extractor chamber, wherein the extractor chamber is disposed below the first aperture.

7. The handgun optic mounting system of claim 1, wherein the first aperture extends from the recessed surface to a first terminal end to form a first aperture depth, and the second aperture extends from the recessed surface to a second terminal end to form a second aperture depth, wherein the second aperture depth is greater than the first aperture depth.

8. A handgun optic mounting system, comprising:

a handgun slide having a proximal end, a distal end, a first half disposed at the proximal end, a second half disposed on the distal end, and an upper surface, the handgun slide comprising a barrel aperture having a barrel central axis; and an optic recess disposed on the handgun slide, the optic recess having a recessed surface disposed lower than the upper surface, the recessed surface forming a recess plane anteriorly tilted wherein the recess plane is angled with at least one of the upper surface or the barrel central axis.

9. The handgun optic mounting system of claim 8, wherein the optic recess is disposed on the upper surface of the handgun slide.

10. The handgun optic mounting system of claim 8, further comprising a recessed angle formed by the recess plane and at least one of the upper surface or the barrel central axis.

11. The handgun optic mounting system of claim 10, wherein the recessed angle comprises a value between and inclusive of 5 to 25 minutes of angle.

12. The handgun optic mounting system of claim 8, the optic recess further comprising a proximal boundary extending from the upper surface to the recessed surface to form a first height, the optic recess further comprising a distal boundary extending from the upper surface to the recessed surface to form a second height, wherein the second height is greater than the first height.

13. The handgun optic mounting system of claim 8, the recessed surface further comprising a plurality of alignment elements.

14. The handgun optic mounting system of claim 8, wherein the optic recess is disposed at the first half.

15. The handgun optic mounting system of claim 8, the optic recess further comprising a plurality of threaded mounting apertures, the plurality of threaded mounting apertures comprising a first aperture and a second aperture each extending into the recessed surface, wherein the first aperture comprises a single mounting protrusion extending above the recessed surface, and further wherein the second aperture terminates flush with the recessed surface.

16. The handgun optic mounting system of claim 15, wherein the single mounting protrusion comprises threads.

17. The handgun optic mounting system of claim 15, the first aperture further comprising a first diameter and the second aperture further comprising a second diameter wherein the second diameter is greater than the first diameter.

18. The handgun optic mounting system of claim 15, the handgun slide further comprising an extractor chamber, wherein the extractor chamber is disposed below the first aperture.

19. The handgun optic mounting system of claim 15, wherein the first aperture extends from the recessed surface to a first terminal end to form a first aperture depth, and the second aperture extends from the recessed surface to a second terminal end to form a second aperture depth, wherein the second aperture depth is greater than the first aperture depth.

* * * * *